US006313424B1

(12) United States Patent
Bachofen

(10) Patent No.: US 6,313,424 B1
(45) **Date of Patent: *Nov. 6, 2001**

(54) MULTIPOLAR SWITCH

(75) Inventor: Felix H. Bachofen, Oberentfelden (CH)

(73) Assignee: Gec Alsthom T&D AG, Oberentfelden (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/883,438

(22) Filed: Jun. 26, 1997

(30) Foreign Application Priority Data

Jun. 26, 1996 (EP) ..... 96110256

(51) Int. Cl.[7] ..... H01H 33/42

(52) U.S. Cl. ..... 218/6; 218/153; 200/48 V; 200/337

(58) Field of Search ..... 218/154.7, 78, 218/84, 120, 140, 75, 6, 153; 200/5 R, 48 CB, 48 V, 337

(56) References Cited

U.S. PATENT DOCUMENTS 1,740,531 * 12/1929 Aalborg ..... 218/5 X
2,878,331 3/1959 Fjellstedt et al. .
5,510,590 * 4/1996 Hux ..... 218/6

FOREIGN PATENT DOCUMENTS

3810453A1 10/1988 (DE) .
0663675A1 7/1995 (EP) .
1082509 12/1954 (FR) .

* cited by examiner

*Primary Examiner*—Renee Luebke
(74) *Attorney, Agent, or Firm*—Sughrue, Mion, Zinn, Macpeak & Seas, PLLC

(57) ABSTRACT

A multipoint switch, especially for high voltage, having identically configured interrupter units (2, 3, 4), the pivoting contacts (10) of which are connected to a common drive (44) by a linkage mechanism (50, 60, 71) associated with the interrupter unit (2, 3, 4) and by a drive linkage (47), whereby the linkage mechanisms (50, 60, 71) of all interrupter units (2, 3, 4) are identically configured and are moved back and forth between the on- and off-position by the drive. Each linkage mechanism (50, 60, 71) includes a rocker arm (21, 65) attached to a pivoting shaft (20, 64) and a connecting rod (22, 63) articulated to it and to the pivoting contact. A rocker link (27, 66) is arranged on the pivoting shaft (20, 64), which under combined action is connected to the drive linkage (47) with at least another linkage mechanism (32, 33, 36, 62, 70). Two operatively combined links of the linkage mechanism (50, 60, 71) take a position at least close to a stable position in the on- and off-position. The relative position of the linkage mechanisms (50, 60, 71) of the separate interrupter units (2, 3, 4) is adjustable, allowing a precise adjustment of relative switching time points of separate terminals, as well as an exact adjustment of simultaneity of all terminals.

6 Claims, 6 Drawing Sheets

1
2
3
4
8
9
10
11
13
14
16
17
20
21
22
27
28
29
30
32
33
36
40
41
42
43
44
45
47
50
54
B
C
E
A
α2
α3
α4

1"
1"
2
3
4
8
10
63
63a
64
65
66
67
68
69
70
71
16
17
40
41
42
43
44
45
47
δ2
δ3
VIII
VIII

MULTIPOLAR SWITCH

BACKGROUND OF THE INVENTION

The invention concerns a multipolar switch, especially for high voltage.

A switch of this type is known from EP-A-O 663 675. This switch is equipped for all terminals with identically configured interrupter units, the contacts of which are each connected to each linkage associated with an interrupter unit, as well as to a drive rod with a mutual drive for all interrupter units. Each drive linkage is equipped with the contact connecting a shaft with the transmission rod, as well as a torsionally tight rocker arm located on the shaft, which is designed as a double-lever, with its partial lever featuring a different pivot position in relation to the shaft. In order to produce a switching time difference between two terminals, the partial levers are at different angles relative to the drive rod. The difference of the switching time points is determined by the angle between the two partial levers. In order to change them, the double-levers must be replaced. Fine adjustment of the switching time points, for instance for balancing of any leakage of the drive power, is difficult. A further disadvantage is the fact that the manufacturer of such switches must have enough double-levers. with the matching drive rods in stock for at least four different switching time delays, in order to realize all practically possible combinations.

SUMMARY OF THE INVENTION

A goal of the present invention is to create a switch of the above mentioned type, which makes it possible to accomplish practically all desirable sequences of the switching time points of separate terminals with identically configured linkage mechanisms.

According to the invention the switch enables a precise adjustment of the desired relative switch times, as well as an exact adjustment simultaneously of all terminals. Should a switch with simultaneously switching contacts, as well as such with time sequenced switching, be used in a system, no differently configured switches must be kept on reserve.

BRIEF DESCRIPTION OF THE DRAWINGS

The invention will now explained in more detail with reference to the three examples illustrated in the drawings, wherein.

DETAILED DESCRIPTION OF THE INVENTION

Figures 1, 2:
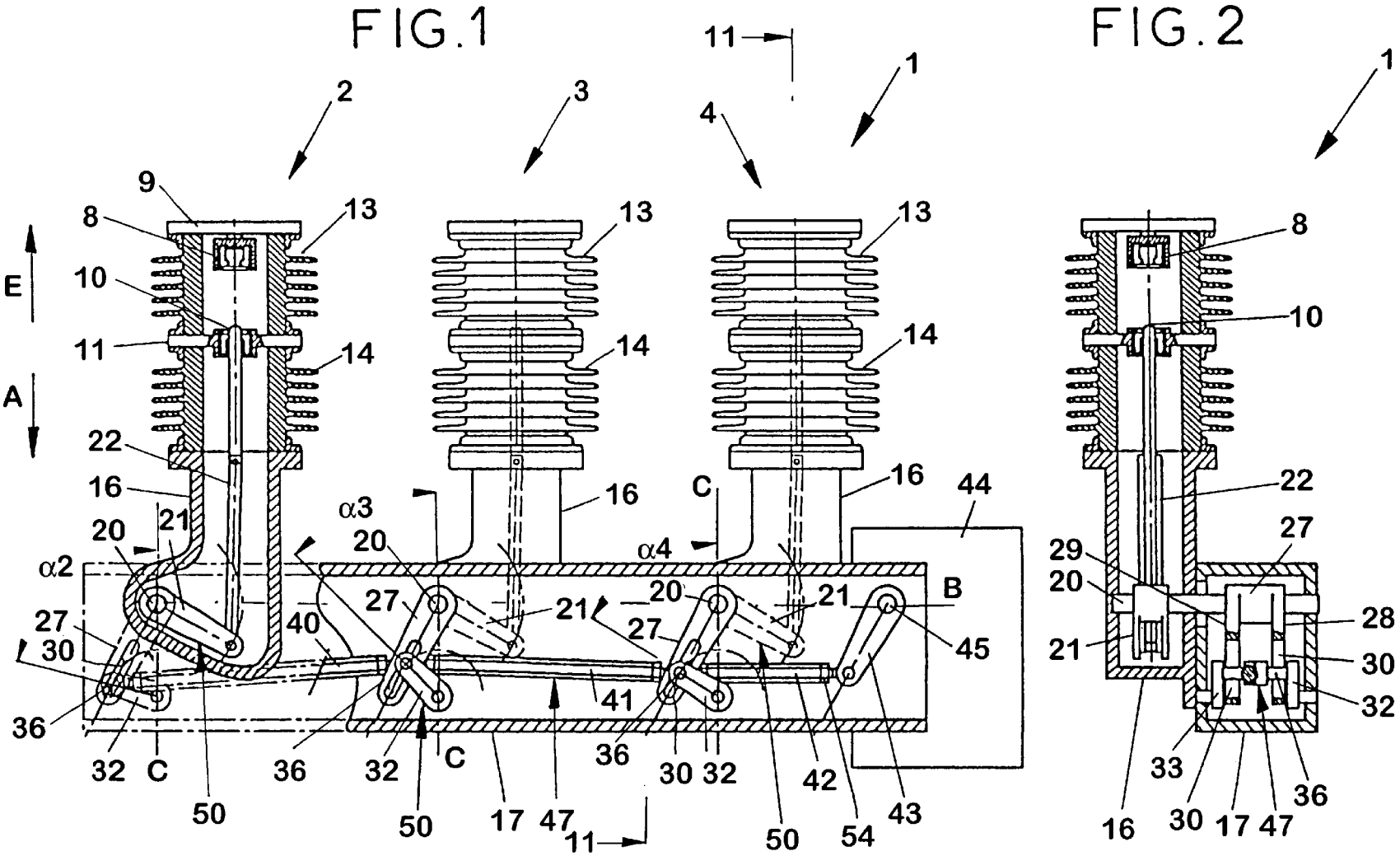
FIG. 1. is a first example of a three-pole switch in a front view and partially in sectional view of three interrupter units being in the off-position.
FIG. 2 is a sectional view along line II—II in FIG. 1.

According to FIG. 1, a three-pole high voltage switch 1 designed as a pressurizing gas switch, features three identically configured interrupter units 2, 3, 4. Each interrupter unit 2, 3, 4 is equipped with a stationary contact 8, which is electrically connected to a first connection flange 9.

Working together with the stationary contact 8, which is electrically connected to a second connection flange 11, each contact 10 is used for switching to the on position in the direction of the arrow E and for switching to the off position in the direction of the arrow A. The contacts 8, 10 are arranged inside of a switching chamber insulator 13, which is supported on a mechanism casing 16 by a supporting insulator 14. The mechanism casings 16 of the interrupter units 2, 3, 4 are attached to a box-type chassis 17 common to all interrupter units 2, 3, 4.

A pivot shaft 20 running transverse to the switching direction is arranged in each mechanism casing 16 of each interrupter unit 2, 3, 4, penetrating the mechanism casing 16 and the chassis 17. A rocker arm 21 is fixedly secured to that part of the shaft 20 running inside of the mechanism casing 16, and is connected to the contact 10 by an insulating rod arranged as a connecting rod 22. The connecting rod 22 is articulated to the rocker arm 21 at one end and to the contact 10 on the other end. All shafts 20 are on a common level B and are parallel to each other.

Figure 3:
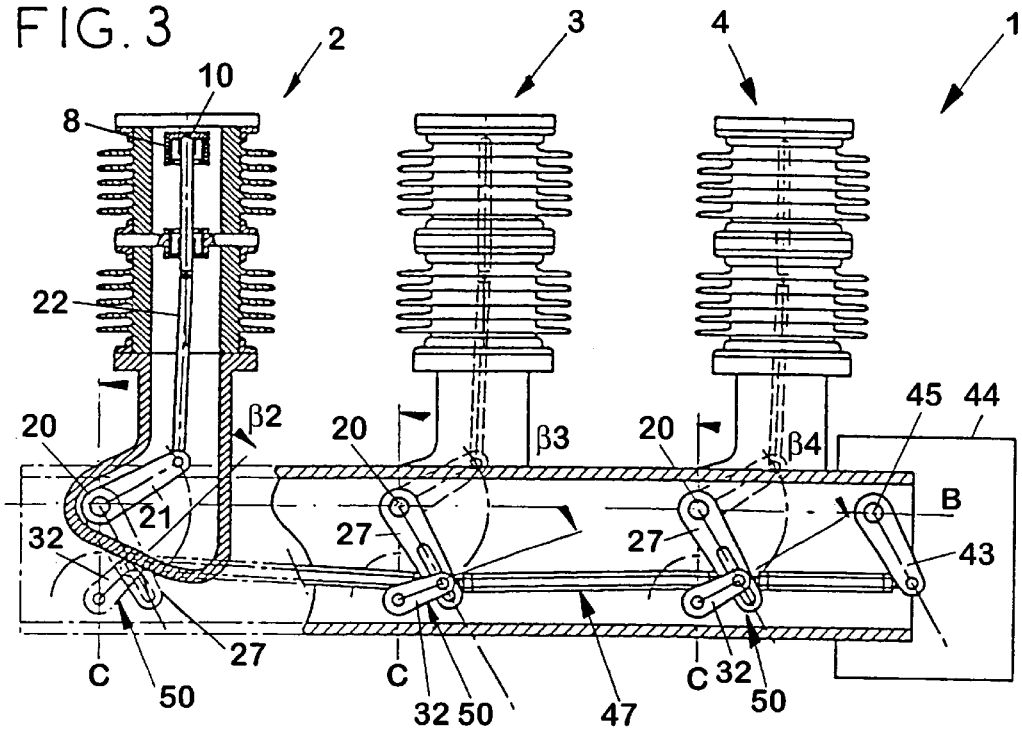
FIG. 3 shows the switch according to FIG. 1 with the interrupter units being in the on-position.

In the example illustrated in FIGS. 1 through 3, the preferred swivel of the rocker arms 21 is within an angular range of 50° to 130°. Both end-point positions of the rocker arms 21 are illustrated in FIGS. 1 and 3, whereby the end-point position in FIG. 1 corresponds to the off position of the high voltage switch 1. FIG. 3 shows the on position of the high voltage switch 1, in which the contact 10 protrudes into the inside of the tulip-like stationary contact 8.

The part of each shaft 20 within the chassis 17 has a bifurcated rocker link 27, both arms 28, 29 (FIG. 2) of which are provided with a slot 30 running radially relative to the shaft axis. A respective swivelling auxiliary lever 32, 33, each arranged in the chassis 17, is adjacent each of the two outer surfaces of the arms 28, 29. The auxiliary levers 32, 33 are parallel to each other and are connected to each other by a rod or bolt 36, protruding through the slots 30 of the bifurcated rocker link 27, thereby forming a crank-type structure.

The bolt 36 of the center interrupter unit 3 is linked by a respective coupler 40, 41 to the bolt of the other interrupter units 2, 4. A drive coupler 42 is articulated to the bolt 36 of the interrupter unit 4, and is linked at one end to the driver lever 43. The drive lever 43 is situated on a drive shaft 45 of a drive 44.

The drive coupler 42 and the couplers 40, 41 form a drive linkage 47, which connects all interrupter units 2, 3, 4 to the common drive 44. The drive 44 causes the movement of the contact 10 back and forth between the on-and off-position by way of the drive linkage 47 and a linkage 50 assigned to each interrupter unit 2, 3, 4, which inlcudes the auxiliary levers 32, 33 with the bolt 36, the rocker link 27, the rocker arm 21, as well as the connecting rod.

When swivelling the drive lever 43 counter clockwise from the position as shown in FIG. 1, the movement to the on-position of the contacts 10 is effected in the direction of arrow E by the drive linkage 47 and the linkages 50 of all interrupter units 2, 3, 4. The clockwise swivelling of the drive lever 43 from the position shown in FIG. 3 causes the off-position movement of the contacts 10 in the direction of arrow A.

The couplers 40, 41 and the drive coupler 43 are designed so they can be adjusted in length. Each coupler 40, 41 and the drive coupler 43 features a hexagonal rod, which is equipped with an internal thread on each end, with an assigned right-hand thread on one end and a left-hand thread on the other end for each respective bolt 36, or the stud bolt screwed into the hexagonal rod, articulated on the drive lever 43. The adjusted coupler length is secured with a locknut 54.

By adjusting the length of the couplers 40, 41, the relative position of the auxiliary levers, 32, 33 and of the bifurcated, slotted rocker links 27 can be changed at each separate interrupter unit 2, 3, 4. Depending on coupler length, the bolt 36 forming the articulation point of the drive linkage 47 is adjusted, with the slots 30 forming a longitudinal guide radially to the shaft 20, whereby the position of the articulation points in relation to the shafts 20 is regulated at the separate rocker links 27.

For instance, as the examples in FIGS. 1 and 3 show, the auxiliary levers 32, 33 of the interrupter unit, as an example interrupter unit 4, can be adjusted in such a way that they are positioned at a right angle to the rocker link 27 in their respective off or on final positions and assume a stable position relative to the rocker link 27. The angles of the auxiliary levers 32, 33 with respect to a vertical plane C at their final positions, are illustrated as $\alpha 4$ and $\beta 4$. As the pivot axes of the auxiliary levers 32, 33, as well as the axis of the shaft 20 are also positioned in the plane C, the angle $\beta 4$ resembles the negative angle $\alpha 4$.

The auxiliary levers 32, 33 of the interrupter unit 3 are, however, adjusted over the drive linkage 47 in such a way that they assume a smaller angle $\alpha 3$ in the off-position according to FIG. 1 in relation to the angle $\alpha 4$ of the auxiliary levers 32, 33 of the interrupter unit 4. However, they include a larger angle $\beta 3$ with the plane C in the on-position, according to FIG. 3. The chosen adjustment of the auxiliary levers 32, 33 is just the opposite at the interrupter unit 2; they are in the off-position at a larger angle $\alpha 2$, according to FIG. 1, than those of the interrupter unit 4 (angle $\alpha 4$), but in the on-position the angle $\beta 2$ is smaller than the angle $\beta 4$, according to FIG. 3.

Figure 10:
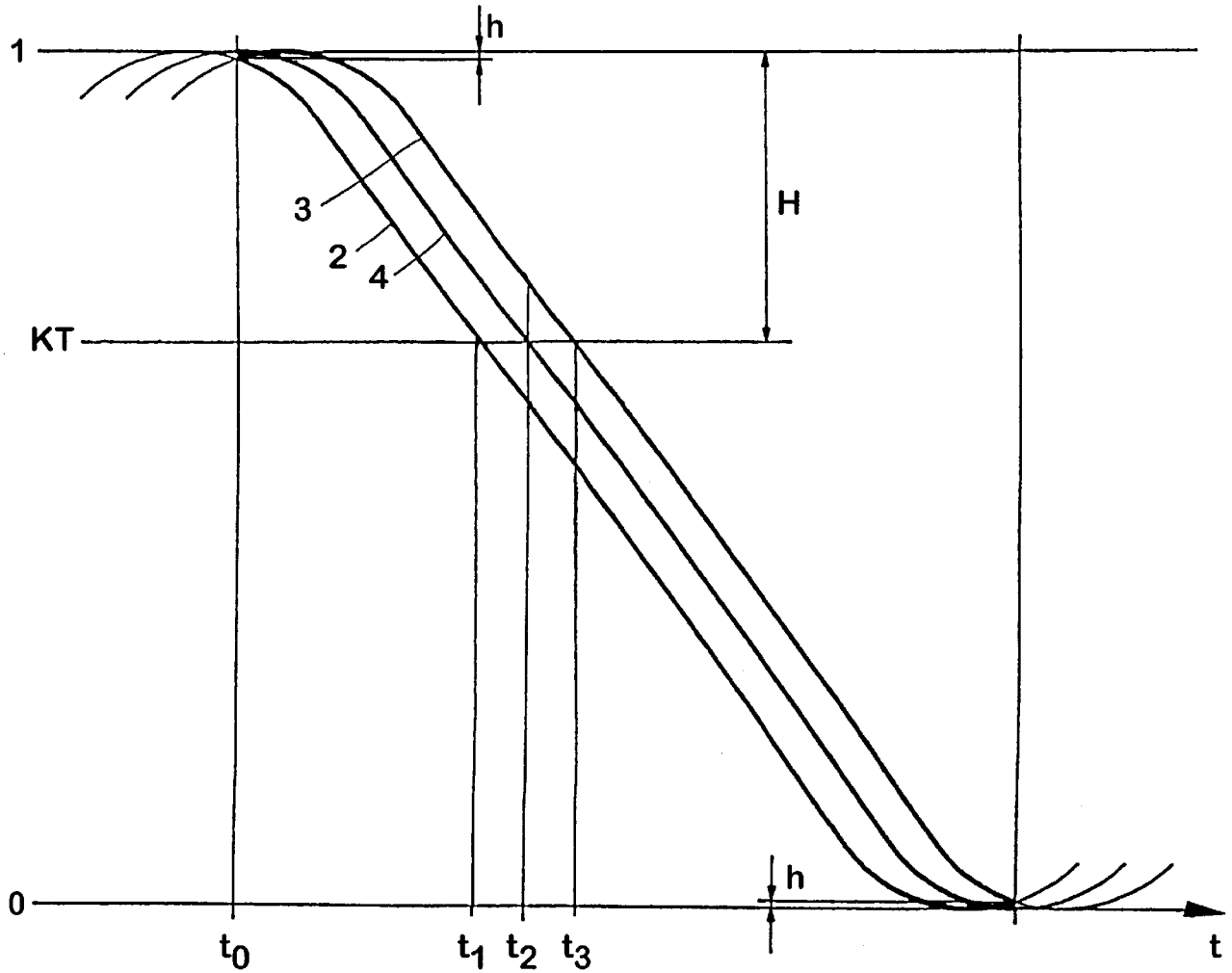
FIG. 10 is a graph showing an example of the temporal deviation course of the make-and-break contacts of the interrupter units of the switches illustrated in FIGS. 1 through 3.

The auxiliary levers 32, 33 of all interrupter units 2, 3, 4 assume, however, in the on-position as well as in the off-position, a position at least close to a stable position relative to the rocker link 27, from which a relatively large movement of the auxiliary levers 32, 33 is necessary in order to substantially change the position of the contact 10. As illustrated in the deviation/time diagram of FIG. 10, the position of the contacts 10 of the interrupter units 2, 3, 4 varies in the on position I (within a time frame t0) only by a minimal amount h, with all contacts 10 being on the inside of the stationary contacts 8, i.e., in contact with the same. When swivelling the drive lever 43, the pivoting contacts 10 of the interrupter units 2, 3, 4 are moved over time away from engagement with the stationary contacts 8, i.e., they perform a level deviation KT necessary for contact disconnection; first the contact disconnection happens at the interrupter unit 2 within a switching time frame t1, as the articulation point of the drive linkage 47 at the rocker link 27 is positioned closest to the shaft 20, according to FIG. 3, therefore the swivel of the rocker link 27 and also of the rocker arm 21 actively connected to the connecting rod 22 takes place at a relatively small movement of the auxiliary levers 32, 33. Then at the switching time point t2, the contact disconnection at the interrupter unit 4 takes place, followed by the switching time point t2 of the circuit breaker unit 3, at which the articulation point of the drive linkage 47 at the rocker link 27 is farthest from the shaft 20, so that a relatively large movement of the auxiliary levers 32, 33 is necessary to swivel the rocker link 27.

By adjustment of the drive linkage 47 length, all types of different deviation times are continuously adjustable within a certain area. It is also possible to adjust an exact simultanousness of all terminals.

Figure 6:
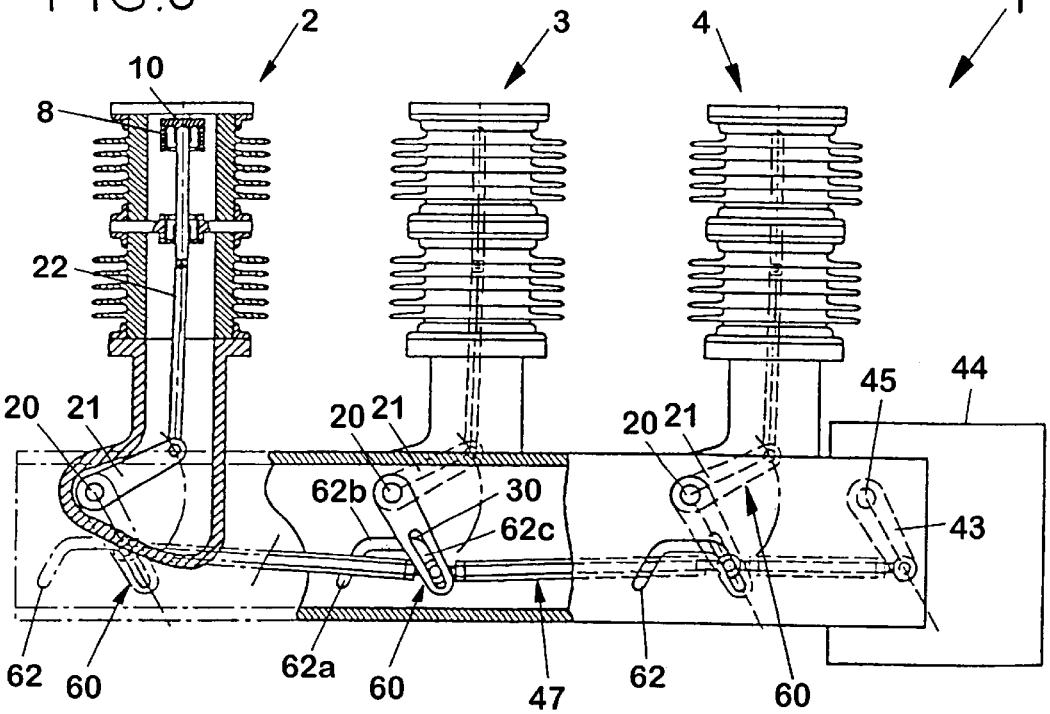
FIG. 6 shows the switch according to FIG. 4 with the interrupter unit being in the on-position.
Figure 5:
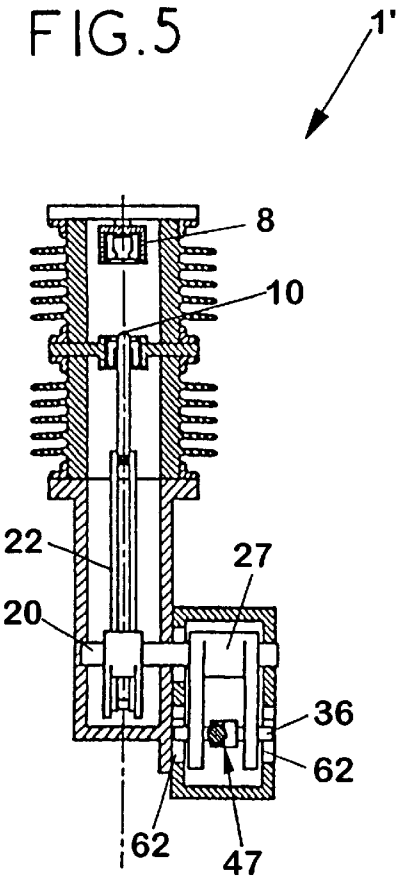
FIG. 5 is a section view along line V—V in FIG. 4.
Figure 4:
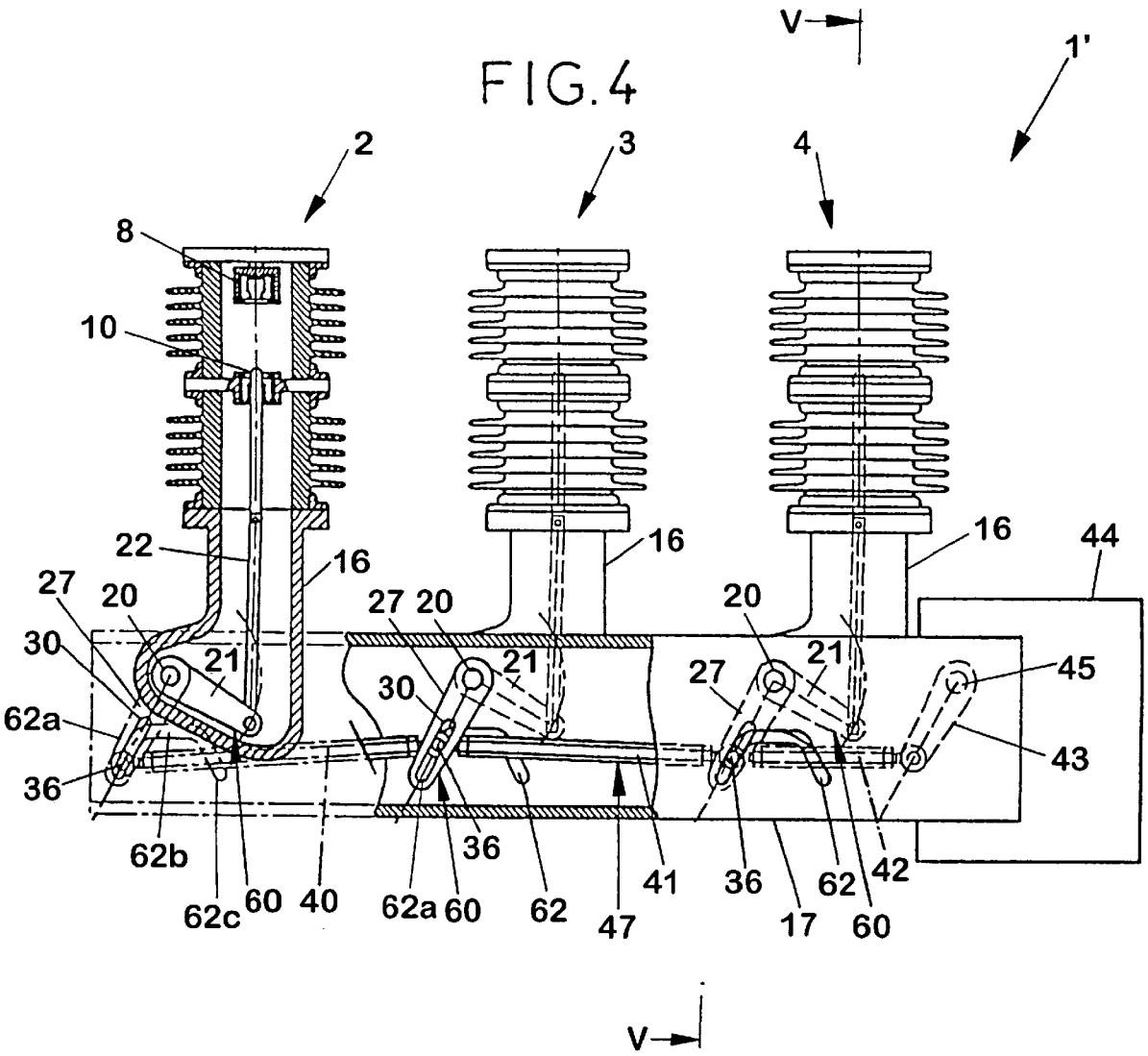
FIG. 4 is a second example of a three-pole switch partially in a front view of three interrupter units being in the off-position.

An additional embodiment of a high voltage switch 1, also with three poles, is illustrated in FIGS. 4 through 6. Furthermore, the similar and commonly acting parts are designated with the same reference numbers as in FIGS. 1 through 3. Again, the contacts 10 of the interrupter units 2, 3, 4 are each actively connected to the rocker arm 21 on the shaft 20 over by the connecting rod 22, the rocker links 27 assembled swivel-fixed on the shafts 20 are also configured the same as those according to FIGS. 1 through 3 and together with the above mentioned auxiliary levers 32, 33 form a part of the linkage 60, associated with each interrupter unit 2, 3, 4, which is also actively connected to the continuously length-adjustable drive linkage 47 in this embodiment. However, the bolt 36 penetrating the slots 30 of the respective rocker link 27, on which the drive linkage 47 is articulated, is in this embodiment not connected to the auxiliary levers, like in the first version, but is instead actively connected to a stationary guideslot 62 arranged on the chassis 17. Each guideslot 62 features a center section 62*b*, as well as two straight end sections 62*a*, 62*c*. In the on or off end-positions, the slots 30 of the rocker link 27 assume a position identical to the end sections 62*a*, 62*c* of the guideslot 62, whereby again achieving a stable position of these two links of the linkage 60 in the on or off end-position of the switch. Similar to the first example according to FIGS. 1 through 3, by adjusting the length of the couplers 40, 41 and the drive coupler 42, the articulation point of the drive linkage 47 and of the respective rocker link 27 can be regulated in its position in relation to the shaft 20, which makes a simultaneous, as well as a time sequenced switching of all terminals possible. FIGS. 4 through 6 illustrate an adjustment example, showing that first the contact disconnection of the interrupter unit 2 takes place when moving the switch from the on-position shown in FIG. 6 to the off-position, as the bolt 36 of this interrupter unit 2 first leaves the end section 62*c* of the guideslot 62 and, reaching the center section, effects the swivel of the rocker link 27. After that, the contact disconnection of the interrupter unit 4 takes place, followed by the interrupter unit 3, the bolt 36 of which is furthest form the shaft 20 in its on-position, according to FIG. 6, and must travel the greatest distance in the end section 62*c*, or in the slot 30, before the swivel of the rocker link 27 takes place.

In this version the position of the contacts 10 of all interrupter units 2, 3, 4 are the same in the on- and off-position.

Figures 7, 8:
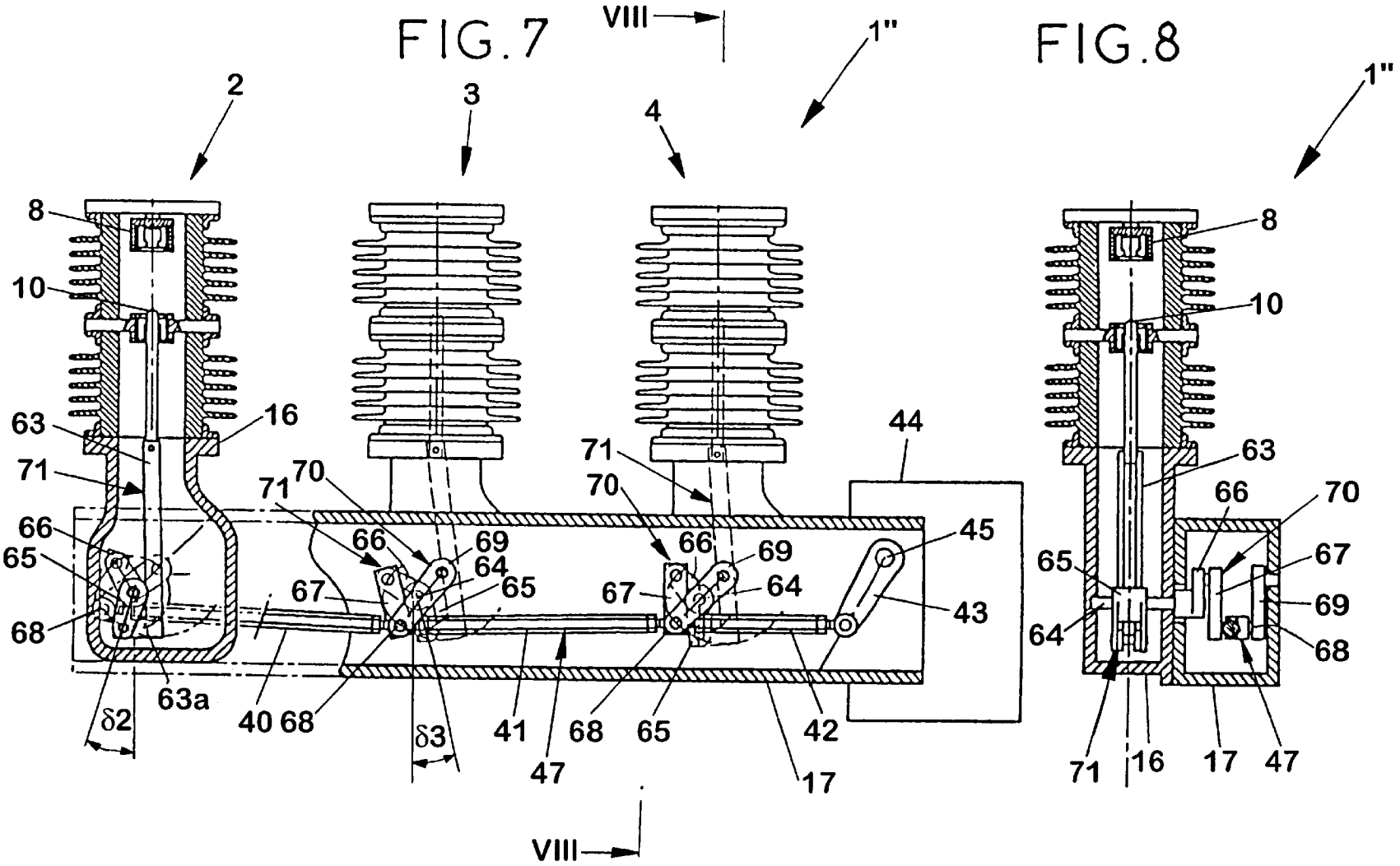
FIG. 7 is a third example of a three-pole switch partially in a front view of three interrupter units being in the off-position.
FIG. 8 is a sectional view along line VIII—VIII in FIG. 7.
Figure 9:
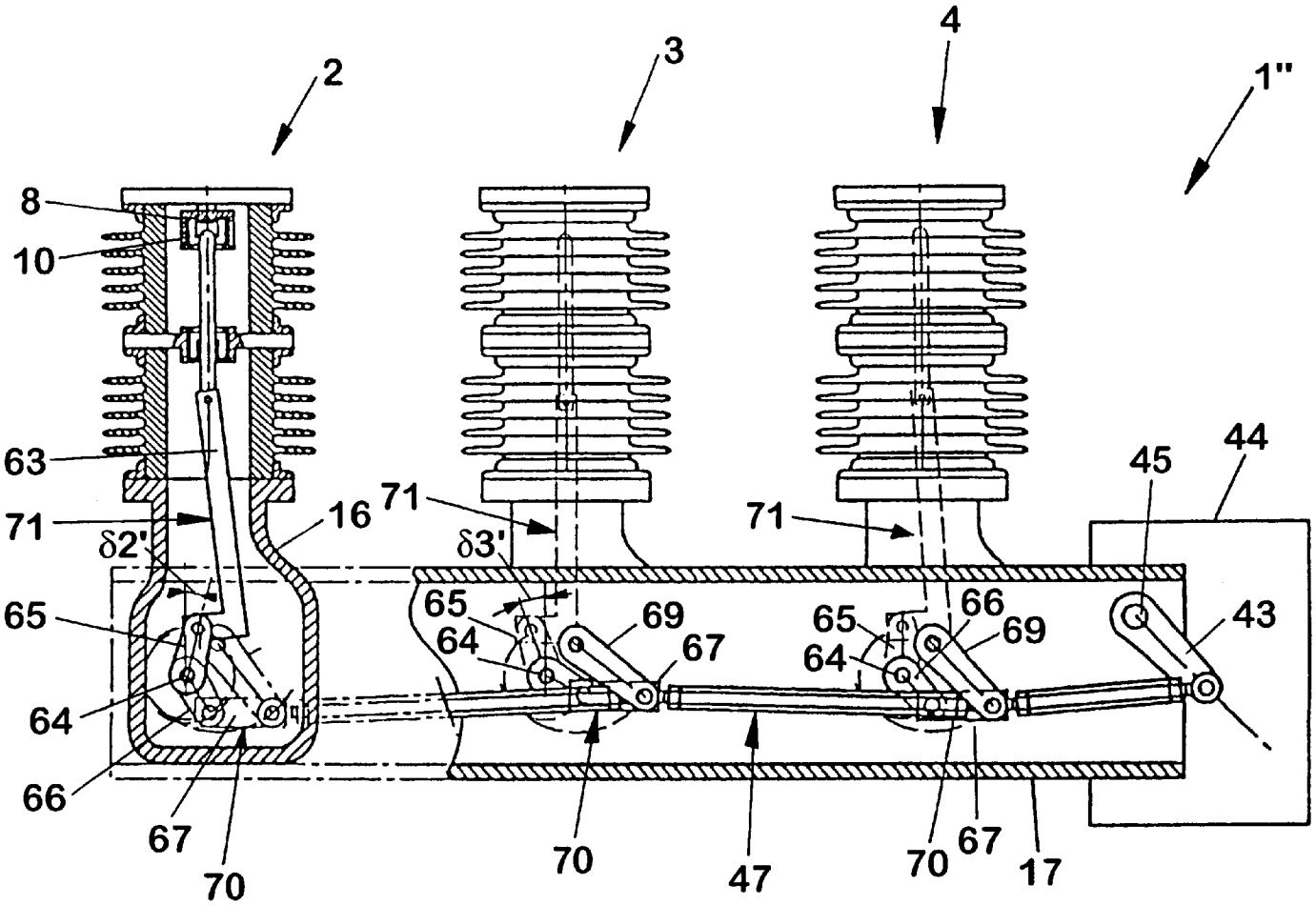
FIG. 9 shows the switch according to FIG. 7 with the interrupter units being in the on-position.

In the third version, illustrated in FIGS. 7 through 9, of a multipolar high voltage switch 10, a respective shaft 64 basically similar to the shaft 20 in FIGS. 1 through 6, is arranged in the mechanism casing 16 of each interrupter unit 2, 3, 4 with a rocker arm 65 rotationally fixed relative to the shaft 64. The rocker arm 65 is operatively connected on one end to the rocker link 66 and at its other end is connected to contact 10 via an articulated connecting rod 63. The end of the connecting rod 63 at the drive side is offset as shown at 63*a* in FIGS. 7 and 9. The articulation point between the connecting rod 63 and the rocker arm 65 is positioned at the offset part 63*a* of the connecting rod 63.

A rocker link 66 is attached to the part of the shaft 64 penetrating the chassis 17, which forms a part of the articulated square 70 which also includes a crank link 69 and a coupler link 67 arranged to swivel in the chassis 17. The coupler link 67 is on one side articulated to the rocker link 66 and on the other side it is arranged on an axle 68, which is arranged on the crank link 69. The drive linkage 47 common to all interrupter units 2, 3, 4 is articulated on the axles 68 of the interrupter units 2, 3, 4.

In this embodiment, each interrupter unit 2, 3, 4 is also assigned a linkage, designated 71 in FIGS. 7 through 9, only this time a linkage includes the rocker arm 65, the connecting rod 63 and the articulated square 70, which is connected to the common drive 44 by the drive linkage 47.

The articulated square 70 of the linkage 71 causes transformation of the swivelling movement of the drive lever 43 in a range of approximately 90° into a swivelling movement of the rocker arm 65 over about 180°; taking the rocker arm 65 between both end positions, corresponding to that of the off-position according to FIG. 7 and that of the on-position according to FIG. 9, and through a stabler position in relation to the connecting rod 63, in which the rocker arm 65 and the non-offset part 63*b* of the connecting rod 63 are placed in a position at least close to the switching direction of the pivoting contact 10, so that a relatively large swivelling of the rocker arm 65 is necessary from this position to substantially change the position of the contact 10.

In this embodiment, simultaneous and time sequenced switching of the separate terminals can also be realized by adjusting the length of the couplers 40, 41. FIGS. 7 through 9 show an adjustment, at which the rocker arm 65 of the interrupter unit 4 is placed over the articulated square 70, as well as in the off-position according to FIG. 7, and in the on-position according to FIG. 9, parallel to the switching position of the contact 10. On the other hand, the rocker arm 65 of the interrupter unit 3 is pivoted by an angle δ3, or δ3' counter clockwise at both end positions, the rocker arm 54 of the interrupter unit 2, however, takes a swivelled position clockwise by an angle δ2, or δ2' at both end positions. In the off- and on-position, all rocker arms 65 are at least close to the stable position in relation to the connecting rods 63, which corresponds to a minimal deviation h (FIG. 10) of separate contacts 10. The crank links 69 and the coupling links 67 of the linkages 71 are also at different positions from each other, which results in the fact that a swivelling of the drive lever 43 from the on-position counter clockwise, according to FIG. 9, first causes a contact disconnection of the interrupter unit 3, followed by the interrupter unit 4 and last by the interrupter unit 2. The contacts for the procedure to switch in the on-position are effected in the opposite order.

In all three examples, practically all desirable sequences of switching time points of the terminals can be finely adjusted over a given range, for the reduction of overvoltages and/or switch strain with linkages 50, or 60, or 71, which are composed of identically configured links. In all examples a simultaneous switching of all terminals can also be adjusted exactly. If switches with time sequenced as well as simultaneously switching contacts are to be used in systems, the use of only one switch embodiment is necessary.

What is claimed is:

1. A switch having a plurality of poles, comprising:

a plurality of interrupter units comprising identical structural elements for each of said poles, each of said structural elements of said plurality of interrupter units including:

a contact connected to a common drive by a first linkage mechanism associated with a corresponding one of said interrupter units and by a drive linkage, whereby each said first linkage mechanism has identical structural elements and each said structural elements of said first linkage mechanism includes:

a rocker arm attached to a shaft penetrating a mechanism casing of each of said interrupter units, a connecting rod directly articulated to the rocker arm and the respective contact, and a rocker link arranged on and rotationally fixed with respect to the shaft, in that the rocker link is connected to the drive linkage by at least a second linkage mechanism, at least one link of the second linkage mechanism taking a stable position in on- and off-positions of said contact, and a position of said second linkage mechanism is adjustable for adjusting switching time points of each of said interrupter units.

2. A switch according to claim 1, wherein the drive linkage comprises length-adjustable couplers for adjustment of a relative position of each said second linkage mechanism.

3. A switch according to claim 1, wherein the rocker link comprises a longitudinal guide, proximate to the shaft, which acts with said second linkage mechanism, such that an articulation point of the drive linkage is slidable in its position in relation to the shaft.

4. A switch according to claim 3, wherein said second linkage mechanism is configured as an auxiliary lever swivelling around an axle, and which further comprises a bolt forming the articulation point for the drive linkage and which protrudes into the longitudinal guide, whereby the auxiliary lever takes a position substantially at a right angle, to the rocker link and the longitudinal guide in the on- and off-positions.

5. A switch according to claim 3, wherein the drive linkage is articulated to a bolt guided in a stationary guide slot, the bolt protruding into the longitudinal guide of the rocker link, whereby the guide slot comprises two end sections that are configured so that (1) the longitudinal guide takes an identical position with one end section, in the on-position, and (2) the longitudinal guide takes an identical position with the other end section, in the off-position.

6. A switch according to claim 1, wherein the rocker link forms a part of an articulated square comprising a crank link swiveled back and forth by the drive linkage, the drive linkage connected to the rocker link by a coupler link in such a way, that the swiveling of the crank link taking place in a limited angle area is transformed into a swiveling of the rocker link and therefore, also of the rocker arm by 180°, whereby the rocker arm takes a stable position in the on- and off-positions.

* * * * *